United States Patent [19]

Goldfarb et al.

[11] 4,120,497

[45] Oct. 17, 1978

[54] TARGET GAME WITH RELEASABLE OBJECTS AND ROTATING TARGET MEMBER

[76] Inventors: Adolph E. Goldfarb, 4614 Monarca Dr., Tarzana, Calif. 91356; Erwin Benkoe, 17965 Medley Dr., Encino, Calif. 91316

[21] Appl. No.: 770,606

[22] Filed: Feb. 22, 1977

[51] Int. Cl.[2] ..... A63B 63/06; A63F 7/02

[52] U.S. Cl. ..... 273/95 B; 273/105.2; 273/106 E

[58] Field of Search ..... 273/101, 95 B, 101.2, 273/106 E, 105.2; 35/25; 46/76 R, 77

[56] References Cited

U.S. PATENT DOCUMENTS

| | | | |
|---|---|---|---|
| 1,559,140 | 10/1925 | Wolkenhauer | 273/101 |
| 1,570,419 | 1/1926 | Wolkenhauer | 273/101 |
| 2,286,151 | 6/1942 | Miller | 273/95 B |
| 2,298,951 | 10/1942 | Lohr et al. | 273/95 B |
| 2,413,633 | 12/1946 | Jones | 35/12 N |
| 2,483,164 | 9/1949 | Wheeler | 273/95 B |
| 2,536,718 | 1/1951 | Brandon | 35/25 |
| 2,663,969 | 12/1953 | Kellogg | 273/95 B |
| 2,977,117 | 3/1961 | Taylor | 272/31 A |
| 3,693,290 | 9/1972 | Breslow et al. | 273/101 |

FOREIGN PATENT DOCUMENTS

| | | | |
|---|---|---|---|
| 920,846 | 4/1947 | France | 273/95 B |
| 954,143 | 12/1949 | France | 273/95 B |
| 1,097,040 | 2/1955 | France | 273/95 B |
| 241,925 | 4/1946 | Switzerland | 273/101 |
| 316,792 | 10/1956 | Switzerland | 273/95 B |

*Primary Examiner*—Richard C. Pinkham
*Assistant Examiner*—Lawrence E. Anderson
*Attorney, Agent, or Firm*—Robert M. Ashen; Robert J. Schaap

[57] ABSTRACT

A target toy for dropping objects such as parachutes from a carrier simulating an airborne vehicle such as an airplane, onto defined locations on an upwardly presented moving target area. A generally horizontal arm on a base extends above the target area and supports the toy airplane for generally radial back and forth scanning movement. The toy is provided with an optical sighting system which has a sight remote from the airplane and which may include a reducing lens to increase the illusion of height and permit the target locations to be seen in advance. The airplane appears to be flying high over the target area. There are manually operable mechanisms for selectively effecting the scanning movement of the toy airplane and for selectively releasing the parachutes from the airplane. A player can look through the sighting mechanism, can shift the airplane radially back and forth with respect to the rotating target area to sight selected locations on the target area, and can then operate the release mechanism to attempt to drop objects onto such selected locations.

22 Claims, 6 Drawing Figures

TARGET GAME WITH RELEASABLE OBJECTS AND ROTATING TARGET MEMBER

BACKGROUND OF THE INVENTION

This invention relates in general to certain new and useful improvements in target toys, and, more particularly, to target toys for releasing objects from an overhead carrier to a moving target area spaced therebeneath, with the overhead carrier also being movable relative to the movement of the target area.

There are forms of toy airborne vehicles, such as toy airplanes, helicopters and the like, which carry releasable objects. One of such toys includes a simulated toy airplane carrying a row of marbles. This toy airplane was hand-held and the marbles were releasably by means of a push-button release switch on the plane. The plane included a sighting system in the form of a simple cross-hair sight. There was no target provided for use with the toy plane and the players would select their own targets and place them on a supporting surface and move the toy airplane over their target and release the marbles. Thus, there was no coaction between the target and the hand-held airplane. Moreover, the only sighting means was the sight on the airplane.

OBJECTS OF THE INVENTION

It is, therefore, a primary object of the present invention to provide a target toy where one or more objects can be released and dropped from an overhead simulated toy airborne vehicle onto a moving target area located beneath the vehicle, there also being controlled relative movement of the vehicle.

It is another object of the present invention to provide a toy of the type stated where the toy airborne vehicle is shifted radially with respect to a rotating target area.

It is a further object of the present invention to provide a toy of the type stated which has an optical sighting system which permits viewing of a moving target area from a remote position in a manner creating the illusion that the user is observing from a great height and so that a relatively large portion of the target area can be seen to permit the toy vehicle to be moved to a position over a selected location on the target area.

It is an additional object of the present invention to provide a toy of the type stated which can be manufactured at a relative low cost and which is relatively durable in its construction.

It is another salient object of the present invention to provide a method of play in which a toy simulated airborne vehicle is manually selectively positionable over a moving target area, the position of the toy vehicle over the target area can be observed from a remote sighting position, and objects can be manually selectively released from the toy vehicle in an attempt to hit selected target positions.

With the above and other objects in view, our invention resides in the novel features of form, construction, arrangement and combination of parts presently described and pointed out in the claims.

SUMMARY OF THE DISCLOSURE

The illustrated target toy simulates the illusion of observing a target area from a high-flying aircraft, controlling the position of the aircraft over the target area so as to bring it directly over pre-selected locations on the target area, and releasing objects, such as parachutes, in an attempt to drop them onto the pre-selected locations. The illustrated toy comprises generally a self-standing frame which supports the target area as well as a toy aircraft selectively positionable above the target area. In the illustrated target toy the target area is provided by an upwardly presented surface of a disc-shaped member rotatably mounted on the base and caused to rotate slowly and continuously. Defined locations, which may take the form of receptacles, are provided in the target area. The frame further includes an upstanding portion and an arm which extends outwardly over the moving target area. The toy aircraft is mounted for back-and-forth scanning movement along the arm.

The toy includes control means which may have a manually movable actuating member located on the frame remote from the toy aircraft to selectively control the movement of the aircraft along the arm. The illustrated arm extends generally radially with respect to the rotating target area. Thus, as the target area rotates, the toy aircraft may be controlled to move to a position any selected distance from the axis of rotation of the target area. The toy aircraft releasibly carries a plurality of objects, such as parachutes, which can be selectively released through a manually actuatable member which may be located on the frame at a position remote from the aircraft.

The illustrated toy is provided with an optical sighting system that comprises a sight located on the frame remotely from the toy aircraft, a mirror or prisim carried on the toy aircraft, and a reducing lens also carried on the aircraft. This permits the user to look into the sight and to see a relatively large portion of the target. This not only creates the illusion of viewing the target area from a great height from an aircraft which is flying forwardly over the target area, but permits the user to see approaching target locations in sufficient time to permit movement of the toy aircraft into alignment with the path along which that location is moving. The user can then time the release of an object in an attempt to cause it to reach the surface of the target area at the same time that the target location is progressed along its path to be directly beneath the falling object. Thus, the user attempts to time and coordinate the positioning of the toy aircraft and the release of the object so that the object will strike or be received at the target location. Where the target location is a receptacle, the object may be received and retained in that receptacle.

The construction of the sighting system includes the use of a short tubular section extending from the sight toward the toy aircraft; such tubular section limits what the user sees to what is shown in the angled mirror carried by the toy aircraft, while avoiding the undesired illusion of looking down a tunnel which would result from the use of tubular structures extending the full distance between the sight and the mirror.

BRIEF DESCRIPTION OF THE DRAWINGS

Figure 1:
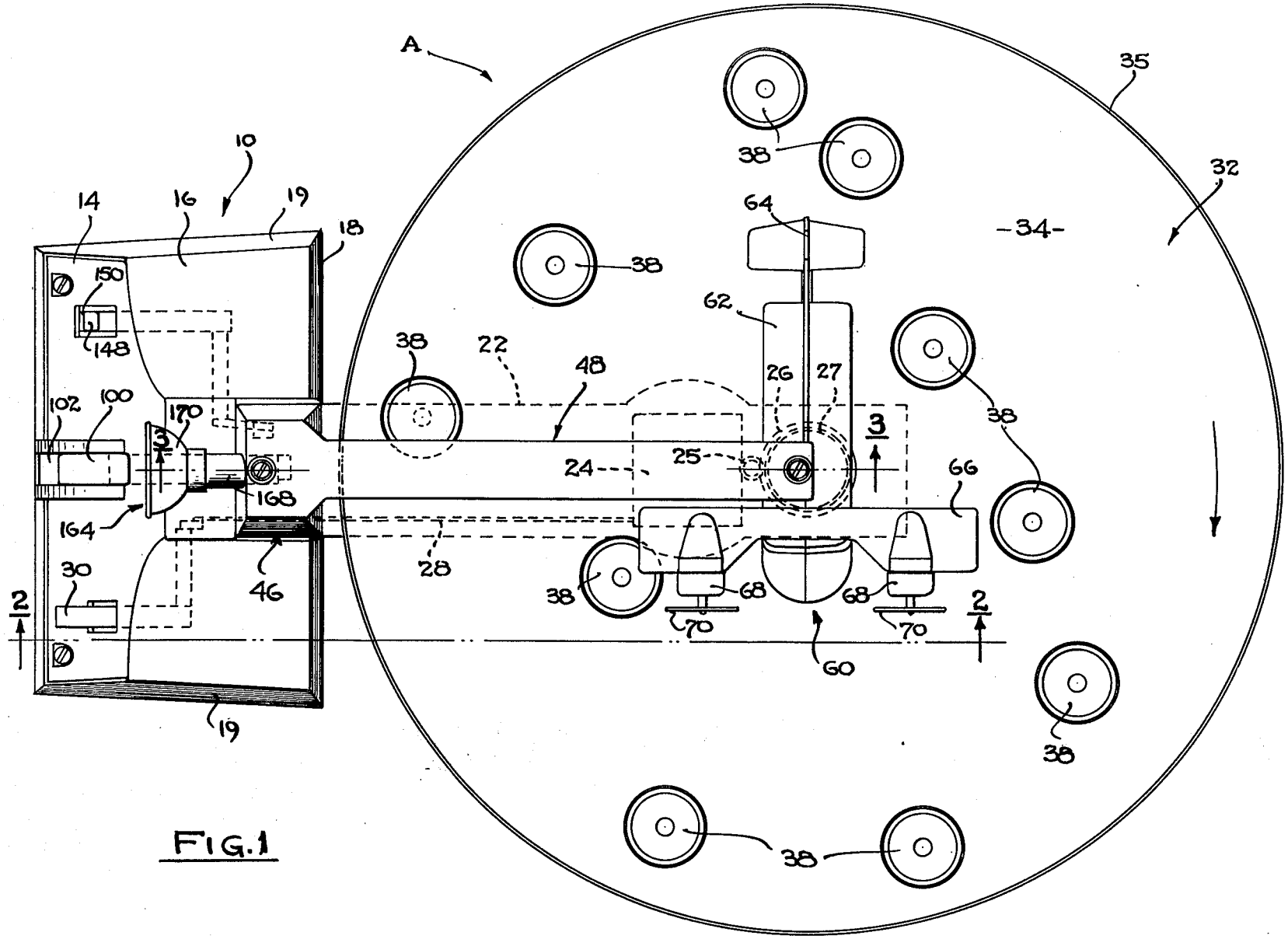
Figure 2:
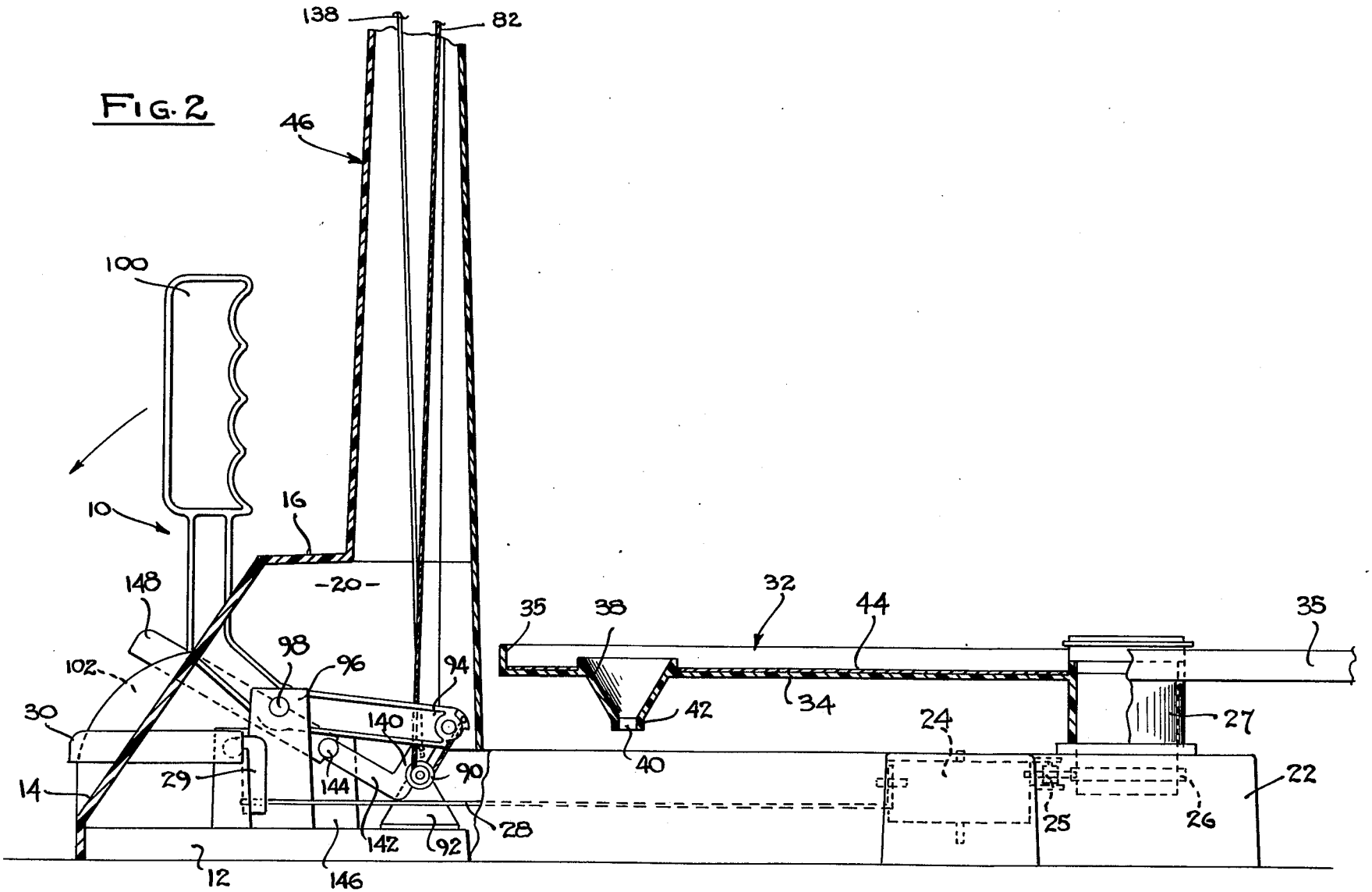
Figures 3, 4, 5, 6:
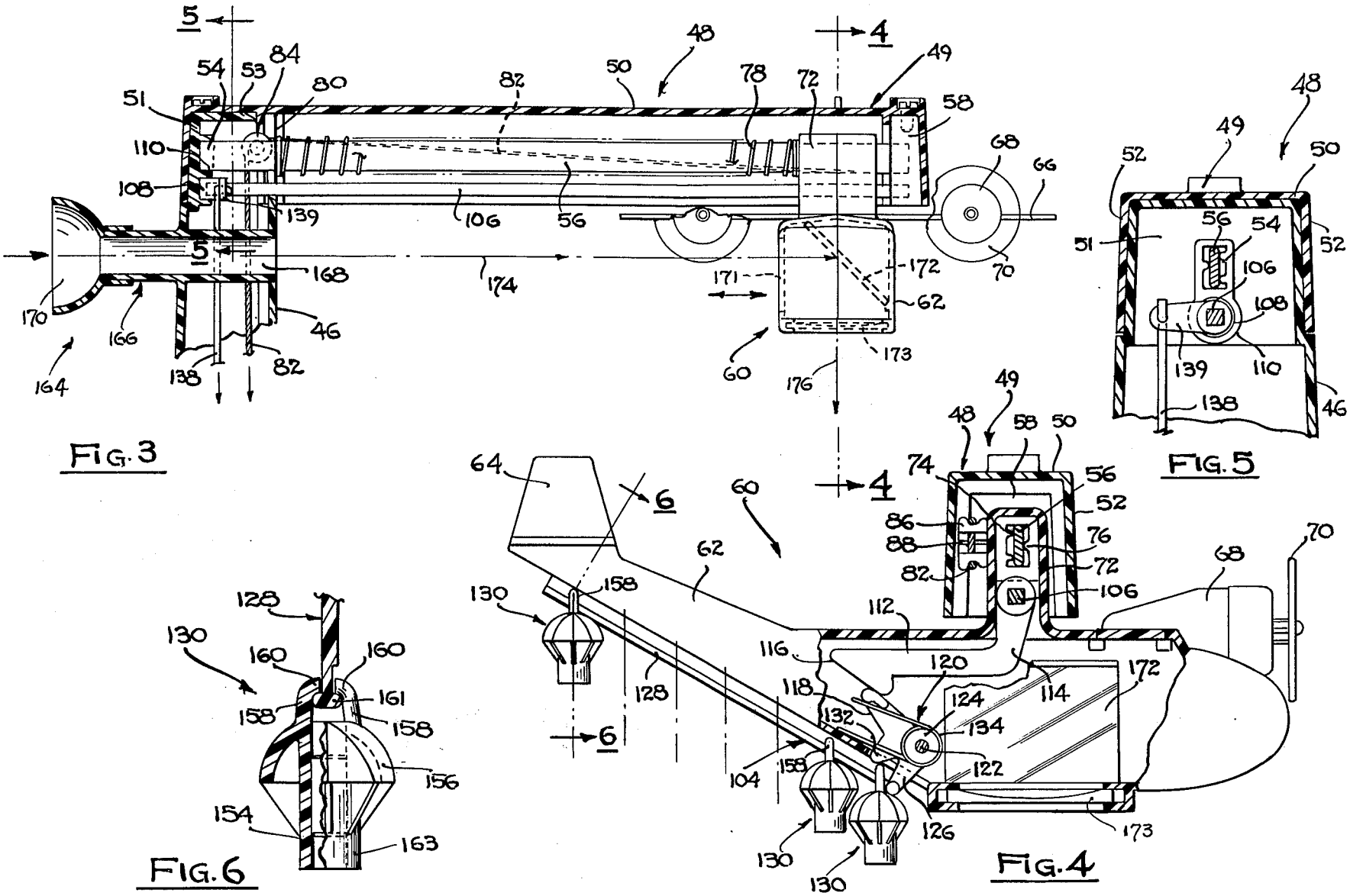

Having thus described the invention in general terms, reference will now be made to the accompanying drawings in which:

FIG. 1 is a top plan view, partially shown in dotted lines, and illustrating a target toy game constructed in accordance with and embodying the present invention;

FIG. 2 is a vertical sectional view, taken along line 2—2 of FIG. 1, and showing a portion of the construction of the base and tower forming part of the device of the present invention;

FIG. 3 is a fragmentary vertical sectional view, taken along line 3—3 of FIG. 1, and showing a portion of the boom mechanism forming part of the device of the present invention;

FIG. 4 is a vertical sectional view, taken along line 4—4 of FIG. 3, and showing the airborne vehicle forming part of the present inventon;

FIG. 5 is a fragmentary vertical sectional view, taken along line 5—5 of FIG. 3, and showing a portion of the mechanism for releasing objects from the airborne vehicle; and FIG. 6 is an elevational view, partially in section taken along line 6—6 of FIG. 4, illustrating an embodiment of a droppable object, forming part of the present invention.

DETAILED DESCRIPTION OF THE PREFERRED EMBODIMENT

Referring now in more detail and by reference characters to the drawings which illustrate a preferred embodiment of the present invention. A designates a target toy game apparatus for dropping objects from a carrier simulating an airborne vehicle to a moving target member. The apparatus A generally comprises a base housing 10 having a bottom plate 12 and an upwardly and forwardly inclined wall 14, reference being made to FIG. 2, which serves as a control panel. Integrally formed with the upper end of the upwardly and inclined wall 14 is a top wall 16. Moreover, the housing 10 is provided with an integrally formed back wall 18 and spaced apart side walls 19 which completely encloses the housing to form an internal chamber 20.

Extending forwardly from the housing 10 at the lower end thereof is a forwardly projecting table supporting frame 22, which is generally rectangular in shape as illustrated in FIGS. 1 and 2 of the drawings. Located within the forwardly projecting frame 22 is a suitable drive motor 24 shown in phantom lines therein and which may be a battery operated electric motor. The motor 24 provides driving power to a pinion gear 25 cooperating with a similar pinion gear 26, both of which are illustrated in phantom lines in FIG. 1. The pinion gear 26 cooperates with an upstanding rotatable shaft 27 which, in turn, carries a target plate 32 causing rotation thereof when the motor 24 is energized. In this respect, it can be observed that the motor 24 and the gearing 25 and 26 are conventional in their construction and are therefore neither illustrated nor described in any further detail herein.

It can also be observed that the motor 24 can be a conventional wind-up motor operated by a coiled spring with the pinion gears 25 and 26 functioning as a type of escapement mechanism. In this way, the player of the game apparatus could merely rotate the table, or other wind-up mechanism, in order to energize the spring retained within the wind-up motor. In either case, a motor control rod 28 extends within the table supporting frame 22 and is connected at its left-hand end, reference being made to FIG. 2, to a rocker arm 29 which is pivotally mounted within the base 10 in the manner as illustrated. A motor control lever 30 is also integral with the rocker arm and when pressed downwardly, will cause a shifting movement of the motor control rod 28 to the right in FIG. 2 of the drawings. In this way, the motor control rod 28 can be connected to a suitable escapement mechanism which permits energization of a spring wind-up motor 24, or otherwise to a switch which permits energization of a battery operated motor or other form of motive means. The lever 30 could be provided with a conventional spring to bias the same to its initial upright position and in which case a switch operated a suitable battery operated motor would be an on-off switch requiring another depression of the lever arm to turn the motor off. Again, the lever could be connected to a suitable escapement mechanism with a wind-up motor so that when it is raised, the motor is deenergized.

The target plate 32 is generally provided with a base plate 34 which is generally circular in shape. In addition, an upstanding circumferentially extending rim 35 extends around the periphery of the base plate 34. It can be observed that the base plate 34 is connected to the upstanding rotatable shaft 27 in the manner as illustrated in FIG. 2 of the drawings.

The target plate 32 is provided in the base plate 34 with a plurality of apertures 36, each of which receive a conically shaped, funnel-like receptacle or cup 38 which has an open lower end 40 for receiving a target object. In this respect, it can be observed that the cup 38 has essentially a true conical shape and which merges into a cylindrically shaped downwardly struck extension 42 which forms the open lower end 40.

A disc 44 is disposed on the upper surface of the target plate 32 and is provided with apertures which match the apertures 36 and are in alignment therewith so that an object may fall through the disc into the receiving cup 38. The target disc is provided on its upper surface with a pattern resembling the appearance of a ground surface when viewed from a normal airborne vehicle, that is from a substantial distance above the ground. In this respect, it can be observed that any number of cups 38 could be provided with the target plate 32 in any desired orientation or location. Moreover, the illustration of the terrain could vary in accordance with the game being played in accordance with the device of the present invention. Thus, the terrain could be designed for receiving objects resembling parachutes. Moreover, the terrain could be so designed with military strategic locations so that the objects which can be dropped from an airplane (hereinafter described) would represent bombs or like objects.

Extending upwardly from the housing 10 is an upstanding mast or tower 46 which is essentially rectangular in shape, in the manner as illustrated in FIGS. 1 and 2 of the drawings. Mounted on the upper end of the mast 46 is an outwardly struck boom 48 which extends over the target plate 32. The boom 48 is enclosed on three sides by a housing 49, preferably rectangular in construction, and includes a top wall 50 with a pair of depending side walls 52, in the manner as more fully illustrated in FIGS. 3–5 of the drawings. Moreover, the mast 46 is provided at its upper end with a retaining bracket 51 and a forwardly struck flange 53 which engages the rearwardly presented end of the horizontal wall 50, in the manner as illustrated in FIG. 3 of the drawings. In addition, the bracket 51 is provided with a pair of spaced apart flanges 54 which are designed to accommodate the rearward end of a slide bar 56, forming part of the boom 48, also in the manner as illustrated in FIG. 3 of the drawings. The forward end of the slide bar 56 is retained within a retaining section 58 forming in the forward end of the housing 49.

Located on the slide bar 56 for longitudinal sliding movement therealong is a simulated aircraft 60, in the form of an airplane, which is conventionally provided with an outer housing 62, a vertical stabilizer or so-called "tail fin" 64, wings 66 and engines 68 which carry propellers 70. In this respect, any form of conventional airborne vehicle could be used, as for example, a helicopter, space capsule, or the like.

The airplane 60 is carried on the slide bar by means of an inverted U-shaped bracket 72 or so-called ∓pylon" which is integral with the upper portion of the housing 62 forming part of the airplane 60. By reference to FIGS. 4 and 5 of the drawings, it can be observed that the bracket 72 engages the slide bar on one side by a pair of contacts 74 and on the opposite side by a single contact 76 in order to minimize the amount of friction between the bracket 72 and the slide bar 56 during shifting movement of the airplane 60.

The airplane 60 is biased in a forward direction, that is to the right-hand end of the drawing when viewing FIGS. 1 and 3, by means of a compression spring 78 which is disposed around the slide bar. At one end, the compression spring bears against the bracket 72 and at the other end the compression spring bears against and is retained by a depending flange 80 extending from the top wall 50, in the manner as illustrated in FIG. 3. The airplane 60 can be shifted rearwardly along the slide bar 56, against the action of the compression spring 78, by means of a cable 82, such as a piece of string. This cable 82 is trained over the upper pulley 84 and which is also pivotally journaled at the upper end of the mast 46. The cable 82 is also secured to a fitting 86 which is similarly pivoted on the upstanding bracket 72 forming part of the housing. The free end of the cable 82 may be affixed to the fitting 86 by passing same through a locking slit 88 or otherwise affixed in proximity to the airplane.

By reference to FIG. 2, it can be observed that the cable 82 extends downwardly through the mast 46 and is trained around a pulley 90 mounted in the lower end of the housing 10. The pulley is rotationally retained on an upstanding bracket 92 which is, in turn, secured to the bottom wall 12 of the housing 10. The other end of the cable is terminated and fixedly secured to the forwardly presented end of a lever arm 94, the latter of which is also pivotally mounted on a bracket 96 by means of a pivot pin 98. Again, the bracket is located within the base housing 10 and is also secured to the bottom wall 12, in the manner as illustrated in FIG. 2. The lever arm 94 extends outwardly of the housing and is provided at its upper and outer end with a handle grip or so-called "hand grip" 100 to be engaged by the player of the apparatus A. The lever arm 94 is shiftable through an elongate slot 102 formed in the front wall 14.

By means of the above-outlined construction, it can be observed that the player of the game apparatus A can pull rearwardly on the hand grip 100, thereby causing the outwardly extended portion of the lever arm to shift downwardly. The forwardly struck end of the lever arm 94, that is the portion located in the base housing 10, will thereupon shift upwardly about the pivot pin 98. As this occurs, the cable 82 will be pulled downwardly through the mast about the pulley 90. As the cable is pulled downwardly through the mast, the cable will also pull the airplane 60 rearwardly along the slide bar 56, against the action of the compression spring 78, inasmuch as the cable 82 is esentially fixed with respect to the airplane 60. When the player of the device pushes the hand grip 100 forwardly, then the airplane 60 will shift to the forward end of the boom 48 by means of the action of the compression spring 78. In this way, the hand grip 100 serves as a control lever, much in the same manner as a control lever is used in an aircraft in order to orient the position of the aircraft.

The player of the game can selectively locate the aircraft with respect to the target plate 32 by pulling back or pushing forward on the control lever 100. In this way, the player of the game can selectively locate the aircraft with respect to a target area such as those target areas defined by the cups 38.

The apparatus A is also provided with an object release mechanism 104 and which includes a square rod 106 extending beneath the slide bar 56. At its rearward end, reference being made to FIG. 3, the square rod 106 is provided with a cylindrical fitting 108, which is, in turn, received within a cup-shaped recess in a forwardly extending boss 110 on the inner surface of the mast 46, providing a journal for the rod 106. In like manner, the forward end of the square rod 106 is journalled within the retaining end 58 of the housing 49.

A first link 112 is located within the housing 62 of the airplane 60, in the manner as illustrated in FIG. 4, and is provided with an upwardly struck end 114 which is disposed on the square rod 106. At its outer end, the link 112 is provided with a camming surface 116 which engages the upper arm 118 of a rocker link 120, in the manner as illustrated in FIG. 4 of the drawings. The rocker link 120 is pivotally mounted on a pintle 122 and is also provided with a downwardly struck release arm 126 which is capable of being selectively engageable with the lower end of an object retaining bar 128, the latter being mounted on the underside of the housing 62. In this respect, it can be observed that the housing 62 has a portion which is angulated upwardly so that the object retaining bar 128 inclines downwardly toward the forward end of the aircraft 60, in the manner as illustrated in FIG. 4 of the drawings.

A plurality of objects 130 are retained on the retaining bar 128 in a manner to be hereinafter described in more detail. It can be observed that these objects 130 will slide downwardly along the retaining bar 128 to the lower end thereof where they are retained by means of the release arm 126. The rocker link 120 is also integrally provided with an intermediate arm 132 which prevents the dispensing of no more than one object upon each release, in a manner to be hereinafter described in more detail.

It can be observed that if the square rod 106 is rotated, as for example in a counter-clockwise direction, then the outer end of the first link 112 will be urged downwardly. As this occurs, the camming surface 116 will bear against the upper arm 118 of the rocker link 120, causing the entire rocker link 120 to rotate in a counter-clockwise direction about the pintle 122. The release arm 126 will also rotate in a counter-clockwise direction away from the lower end of the retaining bar 128. Thus, the lowermost of the objects 130 will be permitted to fall off of the lower end of the retaining rod 128. However, it can be observed that the intermediate link arm 132 will is simultaneously shifted downwardly so as to engage the next above object, preventing the next object from dropping off of the retaining bar 128. As the square rod 106 is permitted to rotate (in a clockwise direction) to its initial position as illustrated in FIG. 4, then the intermediate link arm 132 will be shifted upwardly and, in like manner, the release arm 126 will also be shifted upwardly in a counter-clockwise direction to engage and retain that next lower object from falling off of the retaining bar 128.

In this respect, it can be observed that the rocker link 120 is normally biased to its uppermost position, as illustrated in FIG. 4, by means of a torque spring 134, one end of which bears against the linke 124 on the arm 118.

A release control rod 138 is connected to the square rod 106 by means of an arm 139 so that vertical shifting movement of the control rod 138 will cause rotation of the square rod 106. The control rod 138 extends downwardly through the mast 46 and at its lower end, the release control rod 138 is pivotally connected to the upper arm 140 of a release lever 142. By reference to FIG. 2, it can be observed that the release lever 142 is pivotally mounted within the base housing 10 by means of a pivot pin 144 which is journaled in an upstanding bracket 146 secured to the base wall 12. The release lever 142 is provided at its outer end with a release handle 148 which similarly extends through a slot 150 in the inclined wall 14 of the base housing 10.

In accordance with the above-outlined construction, it can be observed that as the operator of the game pushes downwardly on the release handle 148, as illustrated in FIG. 2 of the drawings, then the release lever 142 and the arm 140 forming a part thereof will pivot in a counter-clockwise direction about the pivot pin 144. As this occurs, the release rod 138 will be shifted upwardly, causing the link 139 to rotate and thereby rotate the square rod 106. As the square rod 106 rotates, it will cause the links 112 and 120 to rotate in the manner as previously described, thereby permitting the release of an object from the retaining rod 128.

One of the objects which may be dropped from the airplane 60 is a simulated parachute containg a relief package, as illustrated in FIG. 6 of the drawings. The simulated parachute includes a vertically disposed elongate housing 154 having a hollow interior along with an outwardly bellowed portion 156 to simulate a parachute. In like manner, the housing 154 is provided at its upper end with a pair of support lugs 158 having internal spaced apart ends 160 to engage an edge head 161 on the upper end of the retaining bar 128.

The object 130 is also provided with a cylindrically shaped lower end 163 for striking the upper surface of the target plate 32 or, otherwise, the lower end 40 of any of the receptacles 38. Moreover, the cylindrically shaped section 163, along with the contour of the outwardly bellowed portion 156, serves to retain the object 130 within the receiving cup 38 when it is dropped. In addition, the object 130 could be designed so that the lower end has a greater weight in order to thereby maintain the object 130 in a normal vertical position in its descent from the airplane 60.

As indicated previously, other forms of objects may be used in accordance with the present invention to simulate other forms of play. Thus, for example, and as pointed out above, the terrain could adopt a different pattern on the disc carried by the target plate so that military objects are displayed. In this way, the released object could simulate a bomb, or a missile or other forms of projectiles.

The apparatus A is also provided with a unique optical sighting mechanism which permits the player of the game apparatus to look through a sight and see a relatively large portion of the target area. The sight is uniquely designed so that it not only creates the illusion of viewing the target area from a great height, as for example, from a flying aircraft, but permits the player to see the approaching target areas in a time which is sufficient to permit the movement of the toy aircraft into alignment with the path along which the target area is moving.

This sighting mechanism 164 comprises a sight piece 166 which is mounted on the upper end of the boom 46 and includes a relatively long tube 168 which is directed toward the position of the airplane 60. The sight piece 166 is provided with an enlarged eye section 170 for the player of the apparatus to place his eye and view through the long tube 168. The airplane 60 is provided with an aperture 171 and a mirror 172 which is located at approximately a 45° angle with respect to the sight piece 166 and with respect to the target plate. A reducing lens 173 is mounted within the lower portion of the airplane housing 62 in a light path between the mirror 172 and the target plate 32. Thus, the player of the apparatus will view through the tube 168 along a first axis, designated as 174, and will be able to observe an image on the target plate through a sight path 176 passing through the reducing lens 173.

The length of the tube 168 is related to the size of the mirror 172 such that when the mirror 172 is located at the maximum distance from the forward end of the tube 168 the viewer cannot see beyond the edges of the mirror. Thus, the tube effectively limits the viewer to see that which is shown in the angled mirror 172 of the aircraft. The tube 168 also avoids the undesired illusion of looking down a tunnel which would result from the use of tubular structures extending the full distance between the sight piece 166 and the mirror 172. The reducing lens 173 creates an illusion that the viewer is looking dow from an airplane from a great height in the same manner as if the viewer were positioned in an airplane.

It should be observed that other forms of sighting mechanisms could be employed, as for example, a prism located within the aircraft in place of the mirror. Other sighting lenses with cross hairs and other forms of optical systems may be employed.

The various components forming part of the apparatus A, except for the slighting glass, can be formed of a number of known plastic materials, including, for example, polyethylene, polystyrene, polybutadiene, a number of known vinylidene copolymers, etc. These components may be formed in any of a known plastic forming techniques including blow molding, injection molding, thermo-forming and the like. However, it should also be observed that many of the components forming part of the apparatus could also be formed of other materials including lightweight metals such as aluminum, or other structural materials.

In use, the player of the game would first start the rotation of the target plate 32 through the motor control lever 30 which would permit the motor 24 to rotate the target member 32 in the manner as previously described. Thereafter, the user of the device would sight a selected target area, that is one of the cups 38, and attempt to shift the airplane 60 by means of pulling rearwardly or pushing forwardly on the control lever 100. In this way, the airplane 60 can be shifted along the boom to the desired position so that it will be in alignment with the path of movement of the selected target area. As the selected target area rotates toward the airplane, the player of the device can time the release of the object so that the object will strike or be received at the selected target area. In this way, various degrees of skill are required in playing the game. For example, the player of the apparatus has to properly position the airplane 60 with respect to an approaching target area and sight the position of the target area through the sight glass. Thereafter the player of the apparatus has to properly time the release of the object so that it will be received by the receiving cup 38.

In this respect and in one of the preferred embodiments of the present invention, the various target areas could have different scoring values. Thus, target areas which are located in a position where they are more difficult to time the release of an object in order to have the object received thereby will have a higher scoring value. In addition, target areas which are remote from other target areas will have a higher scoring value than target areas which are located in a cluster. In this way, several individuals may play the game apparatus and the individual achieving the highest score after a predetermined period of time or a number of tries will win the game.

Thus, there has been illustrated and described a unique and novel toy apparatus and method which permits a user to view an object through a sighting mechanism and shift an airplane into a path so that a releasable object will follow a trajectory to enter the target area upon the proper timed release of the object. Thus, the apparatus and the method fulfill all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by Letters Patent is:

1. A target toy for releasing one or more objects onto a moving target, said game comprising:

(a) base means, (b) a target member rotatably mounted with respect to said base means, and means for generally continuously rotating said member, (c) a frame operatively associated with said base means and having a frame element extending over said target member and being spaced upwardly from said target member, (d) a simulated airborne vehicle operatively mounted on said frame element for movement therealong, (e) control means operatively associated with said frame for causing said movement of said vehicle along said frame element through selective manual actuation by a user, (f) retaining means on said vehicle for retaining a plurality of objects which are capable of being dropped from said vehicle, said retaining means comprising:

(1) an inclined elongate element on said vehicle and having a lower object release end, (2) means suspending said objects on said elongate element, and (3) said elongate element being located in a position where said objects move along said elongate element by the force of gravity toward said release end as objects at said release end are dropped from said vehicle, (g) said release means operatively associated with said retaining means and being selectively manually actuable by a user for releasing the object when said vehicle has been moved to a proper position with respect to said rotating target member, said release means comprising:

(1) a release mechanism located at the release end of said elongate element for releasing individual ones of said objects, (2) a manually actuable release member on said frame, (3) means coupling said release member and said release mechanism so that each manual actuation of said release member will cause said release mechanism to release and drop an individual one of said objects and successive manual actuation of said release member will cause successive dropping of individual objects one at a time.

2. The toy of claim 1 further characterized in that there are a plurality of spaced apart target locations on said target member.

3. The toy of claim 2 further characterized in that said target member comprises a plate-like member having a plurality of recesses therein representing target locations to receive the objects.

4. The toy of claim 3 further characterized in that a disc is disposable on said plate-like member and having apertures corresponding to said recesses, said disc having a representation of a terrain on its upper surface.

5. The toy of claim 1 further characterized in that a remote target sighting system is operatively associated with said toy, said target sighting system comprising a sight operatively supported by one of said base means or frame, and a mirror on said vehicle located with respect to said target member and said sight to enable the upper surface of said target member to be viewed through said sight.

6. The toy of claim 5 further characterized in that said sighting system further comprises a reducing lens disposed in the sight path between said sight and said target member.

7. The toy of claim 6 further characterized in that said sight includes a short tube extending toward the mirror on said vehicle, said tube having a length and cross section such that when the vehicle is at its furthest position from the sight a user's view through the sight will not extend beyond the limits of the mirror.

8. The toy of claim 7 further characterized in that said short tube has a forward end spaced a substantial distance from said vehicle at all positions of said vehicle.

9. The toy of claim 1 wherein said base means and said frame are connected to one another.

10. The toy of claim 1 wherein said base means and said frame are separate from one another.

11. The toy of claim 1 wherein said vehicle moves generally radially with respect to said rotating target member.

12. The toy of claim 1 further characterized in that said control means comprises a movable lever on said base means or frame which can be moved by a user to move said vehicle on said frame element and connecting means operatively connecting said lever and vehicle.

13. The target toy of claim 12 further characterized in that said connecting means comprises cable means operatively connected to said lever and to said vehicle to move said vehicle in one direction, said control means also comprising biasing means to bias said vehicle in the opposite direction.

14. A method of operating a toy for dropping one or more objects from a simulated airborne vehicle onto target positions, said method comprising:

(a) effecting selective movement along one path of a simulated airborne vehicle supported on an arm extending over a target area through manual actuation of a remote lever, (b) causing continuous rotational movement generally transverse to said path by the target area which has a plurality of spaced apart identified target positions on its upper surface, (c) sighting one of the target positions on the target area through a relatively short tubular stationary sight located remote from the vehicle, maintaining the sighting eye substantially stationary, and actuating said remote lever to effectuate said movement to move said vehicle and align a mirror located on said vehicle through said sight to bring into view one of said target positions, and (d) releasing individual ones of a plurality of of objects carried by an elongate element on the vehicle through manual actuation of a remote release member when the vehicle has been shifted to a position relative to the target area, the action of releasing the objects occurring while the user of the toy operates the remote release member and simultaneously looks through the sight at a remote position from the vehicle to drop the object when the selected target position appears in the desired location through the sight and which target position is achieved through such selective movement of the vehicle.

15. The method of claim 14 further characterized in that said method comprises manually shifting a remote lever back and forth to cause transverse back and forth scanning movement of the vehicle on said support arm in a direction generally radial relative to said rotating target area.

16. The method of claim 15 further characterized in that there are a plurality of objects carried by the vehicle, and the objects are selectively released one at a time.

17. A target toy comprising:

(a) means defining a generally horizontal target area disposed on a supporting surface, said target area rotating generally continuously, (b) means defining a self standing base having an upright section and a transverse section extending outwardly from the upright section, said transverse section being positioned with at least a portion thereof extending over and spaced above said target area, (c) an object carrier supported on said transverse section for movement therealong and over said target area, (d) control means on said base selectively manually operable by a user to cause said movement of said carrier on said transverse section, (e) at least one object releasably carried by said carrier, (f) sighting means comprising a relatively short tubular sighting member on said base, an optical element mounted on said carrier and being optically aligned with said sighting member for the entire path of movement of said carrier on said transverse section to enable a user of the toy to look through the sighting member and to view a portion of the target area by means of the optical element, the length and cross section of said sighting member being such that the user's view through the sight will not extend beyond the limits of the optical element when the carrier is at its furthest position from the sighting member, (g) release means on said base in close proximity to said control means and being selectively manually operable by a user to release an object from said carrier, said tubular sighting member being located in relation to said release means to enable a user of said target toy to simultaneously operate said release means while viewing a portion of the target area through said sighting member and in a position remote from said carrier.

18. The toy of claim 17 wherein said sighting means further comprises a reducing lens in the sight path from said sighting member to said target area.

19. The toy of claim 20 wherein said object carrier is a simulated aircraft.

20. The toy of claim 18 wherein said optical element is a mirror.

21. The toy of claim 20 wherein said reducing lens is mounted on said carrier in relation to said mirror.

22. A target toy for releasing one or more objects onto a moving target, said game comprising:

(a) base means, (b) a target member rotatably mounted with respect to said base means, and means for generally continuously rotating said member, (c) a frame operatively associated with said base means and having a frame element extending over said target member and being spaced upwardly from said target member, (d) a simulated airborne vehicle operatively mounted on said frame element for movement therealong and which is radial with respect to said target member, (e) control means operatively associated with said frame for causing said movement of said vehicle along said frame element through selective manual actuation by a user, (f) retaining means on said vehicle for retaining a plurality of objects which are capable of being dropped from said vehicle, (g) release means in proximity to said control means operatively associated with said retaining means and being selectively manually actuable by a user for releasing one of the objects on each actuation thereof when said vehicle has been moved to a proper position with respect to said rotating target member, (g) sighting means comprising a relatively short tubular sighting member on said base, an optical element mounted on said vehicle and being optically aligned with said sighting member for the entire path of movement of said vehicle on said transverse section to enable a user of the toy to look through the sighting member and to view a portion of the target area by means of the optical element, the length and cross section of said sighting member being such that the user's view through the sight will not extend beyond the limits of the sighting element when the vehicle is at its furthest position from the sighting member, and (i) release means on said base in close proximity to said control means and being selectively manually operable by a user to release an object from said vehicle, said tubular sighting member being located in relation to said release means to enable a user of said targer toy to simultaneously operate said release means while viewing a portion of the target area through said sighting member and in a position remote from said vehicle.

* * * * *